US005655457A

United States Patent [19]

Sherman et al.

[11] Patent Number: 5,655,457

[45] Date of Patent: Aug. 12, 1997

[54] SYSTEM OF SUSPENDED SUPPORTS FOR AERIAL TRANSPORTATION

[76] Inventors: Yury Sherman, 511 Beech St., Roslindale, Mass. 02131; Mark Yankelevich, 11 Embassy Rd. Apt. 23, Brighton, Mass. 02135

[21] Appl. No.: 651,264

[22] Filed: May 23, 1996

[51] Int. Cl.[6] ..... B61B 7/00

[52] U.S. Cl. ..... 104/123; 104/124; 104/180; 14/18

[58] Field of Search ..... 104/123, 124, 104/125, 126, 117, 173.1, 180, 196, 197; 248/59, 60, 610; 14/18, 19, 20, 21

[56] References Cited

U.S. PATENT DOCUMENTS

| | | | |
|---|---|---|---|
| 1,262,227 | 4/1918 | Miller | 104/126 |
| 2,127,235 | 8/1938 | Robinson | 14/21 |
| 2,417,825 | 3/1947 | Janke, Sr. | 14/19 |
| 3,604,361 | 9/1971 | Denner | 104/125 |
| 4,069,765 | 1/1978 | Muller | 104/123 |
| 4,953,468 | 9/1990 | Criessels | 104/123 |

FOREIGN PATENT DOCUMENTS

| | | | |
|---|---|---|---|
| 561095 | 9/1993 | European Pat. Off. | 104/124 |

*Primary Examiner*—S. Joseph Morano

[57] ABSTRACT

A system of suspended supports for aerial transportation like ski lifts, tramways, freight ropeways, and high voltage electricity lines, has a main carrying element which is a long-span cable along the route, and which is suspended at its ends. A plurality of spaced supports for the aerial means are hung from the cable. Each support has a rigid element carrying the carrying cable and guy ropes, one end of which is attached to the rigid element and another end which is anchored in the ground. The guy ropes carry horizontal and upward vertical loads, and torques applied to the rigid element and fix a position of the rigid element.

6 Claims, 4 Drawing Sheets

SYSTEM OF SUSPENDED SUPPORTS FOR AERIAL TRANSPORTATION

BACKGROUND OF THE INVENTION

Two main types of carrying structures for aerial transportation and transmission means like ski lift, tramway, freight ropeway, high voltage electricity line, etc. are used:

Type 1—a plurality of supports (usually towers) standing on the ground and spaced at a relatively small distance. The aerial means are placed on a cross beam at the top of the tower. The beam transfers all horizontal and vertical loads and torques from the aerial means to the tower.

Type 2—a carrying cable suspended at its ends by any convenient way. A span of the cable is usually 8–10 times longer than the distance between the towers in (1). The aerial means are supported by a plurality of cross beams attached to the cable. Functions of these beams are similar to (1).

Both types of the carrying structures have drawbacks, especially for routes in mountains and on uneven terrain.

Type 1:

heights of the towers depend on a profile of the ground along a route of the aerial means and might be 200–250 ft. or even more. Cost of such towers and expenses for their erection and maintenance are very high. For profiles with depressions 400–500 ft. towers are actually, not applicable;

towers can be destroyed by strong storm, snow-slip, land slide, earthquake and other natural disasters which happen in mountains rather often. A destruction of even one tower leads to destruction of the aerial means. Restoring works are very expensive.

Type 2:

the carrying cable is subjected to horizontal displacements and rocking of the cable along it's length from one support to another. As a result, special heavy cable, or a number of cables, or a horizontal supporting means for the cable are installed. All these measures sharply increase cost of the aerial means.

With these drawbacks, the advantages of prior art in carrying structures for the aerial means is largely offset by their disadvantages.

SUMMARY OF THE INVENTION

Accordingly, the object of the present invention is a system of suspended supports for aerial transportation and transmission means like ski lift, tramway, freight ropeway, high voltage electricity line, etc. which is highly effective for routes on uneven terrain.

As a main carrying element a long-span cable is used. The cable is placed along a route of the aerial means and is suspended at both ends. One end of the cable is anchored and the other end is attached to a tensioning means.

A plurality of spaced supports for the aerial means are hung from the cable. Each support has a rigid element similar to a cross beam of a traditional tower support and guy ropes which one end is attached to the rigid element and another end is anchored in the ground. The guy ropes carry the horizontal loads and torques applied to the rigid element and, thus, fix a position of the rigid element. This, in turn, prevents horizontal displacements of the cable in each point the rigid element is hung. At the same time, the guy ropes prevent upward movement of the rigid element when the cable is stressed by the tensioning means. A projected profile of the cable above the ground is settled by adjusting lengths of the guy ropes. Each guy rope has means for adjusting its length.

The rigid element is hung from the cable by a saddle. The saddle includes track wheel(s) with a grooved rim having a direct contact with the cable. Therefore, in case of changing the length of the cable, for example, because of temperature elongation, the cable slips by the rigid element. Its length between the end supports and, accordingly, a profile of the cable remain unchangeable. In case of a short route of the aerial means the rigid element can be attached to the cable without the saddle.

An installation of the invented system is realized by the following steps:

the carrying cable is stretched between its end supports, one end of the cable is anchored and the other is attached to a tensioning means; then, a part of the designed tensioning load, enough for stretching the unloaded cable, is applied;

rigid elements with attached guy ropes and main supporting components of the aerial means, such as carrying ropes, hauling ropes, etc. are mounted on the cable and hauled one by one to their working position along the cable;

the lower end of the guy ropes are attached to the anchoring means, then the guy ropes are pulled down until a projected profile of the cable above the ground is reached;

the tension of the cable is gradually increased up to the design level, which also provides the increasing of tension stress in the guy ropes. The lengths of the guy ropes are adjusted, if necessary.

DESCRIPTION OF THE PREFERRED EMBODIMENT

Figure 1:
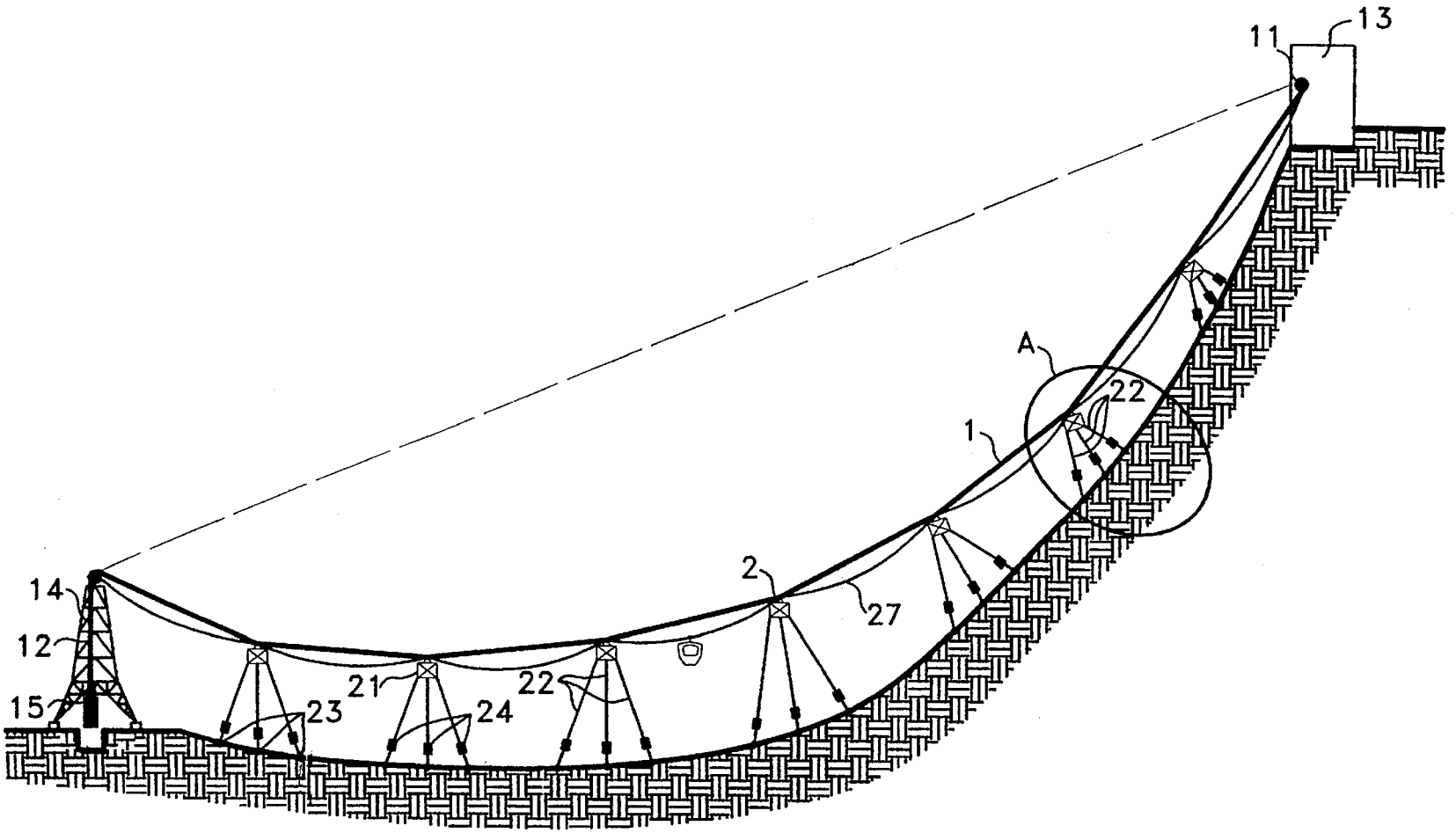
FIG. 1 is a profile of a tramway with main components of the system.

Referring to the drawings in more detail, in FIG. 1 a system of suspended supports for aerial transportation like ski lift, tramway, freight ropeway, high voltage electricity line, etc. and in particular, a system of supports for aerial tramway located in mountains is shown.

The system combines two well known types of carrying structures for the aerial means:

a long-span carrying cable suspended at the ends, which is usually used for routes crossing rivers or lakes, and a plurality of supports (usually towers) spaced at a relatively small distance, standing on the ground.

As shown in FIG. 1, the main carrying element of the system is a suspended long-span cable 1 placed along a route of the aerial tramway. The cable is supported at its both ends. As a supporting means an anchorage, station 13 and a tension station 14 are used. One end 11 of the cable 1 is anchored and the other 12 is attached to a tensioning means which is, for example, a weight balance 15.

The system also includes plurality of supports 2 hung from the cable 1 in any desirable point along the cable.

Figure 2:
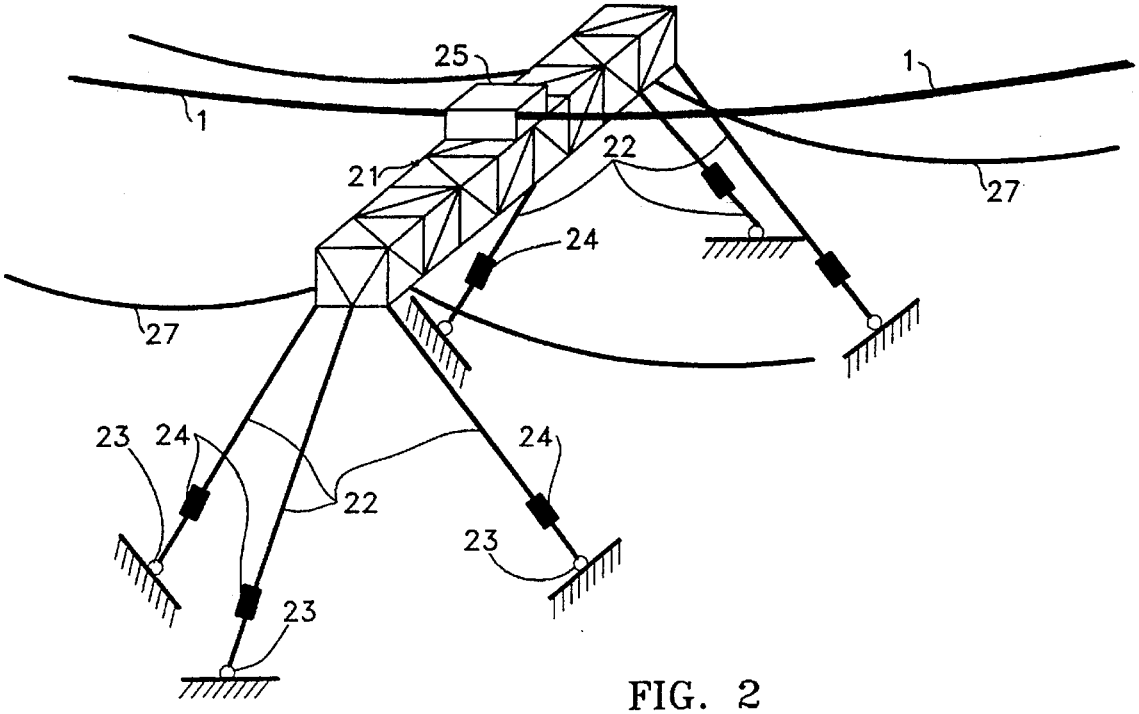
FIG. 2 is an isometric view of the fragment "A" in FIG. 1.

An upper part of each support 2 is a rigid element 21 which is similar to a cross beam of a traditionally used tower FIG. 2. The rigid elements 21 are located substantially perpendicular to an axis of said route of the aerial means. The main purpose of the rigid element is to carry main supporting components of the aerial means, such as carrying ropes 27, hauling ropes, etc.

Guy ropes 22 are attached close to the ends of the rigid element 21 (FIG. 2). Lower ends 23 of the guy ropes are anchored in the ground by tie-backs or any other convenient way or by being embedded in concrete foundation.

The main destinations of the guy ropes are as following:

settling a profile of the cable 1 above the ground, and fixing positions of the rigid elements 21.

Settling a profile of the cable is made in process of installation of the system. When the rigid element 21 is mounted along the cable 1, previously stretched between the anchorage 13 and the tension 14 stations, the guy ropes 22 are pulled down until the rigid element 21 and, accordingly, the cable 1 reach a required level above the ground.

Figure 3:
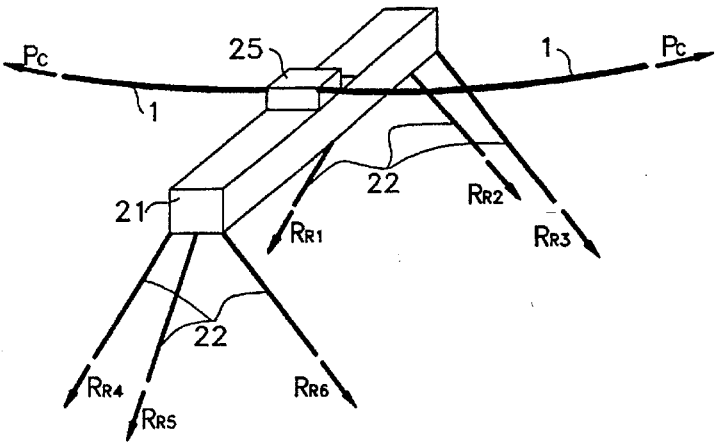
FIG. 3 is a diagram of forces applyed to the carrying cable (Pc) and to the guy ropes (Rr1–Rr6).

As it is shown in FIG. 3 the cable 1 and the guy ropes 22 and, accordingly, the whole system are stressed. Tension of the cable 1 depends on tensioning load Pc applyed to the cable. For given profile of the route tension stress of the guy ropes Rr1–Rr6 varies in proportion to tensioning load applied to the cable 1 and in inverse proportion to lengths of the guy ropes 22. For adjusting the lengths of the guy ropes each of them should be supplied with length adjusting device 24 (FIG. 1).

Fixed position of the rigid elements 21 is provided by the guy ropes 22 carrying, as it is clear from FIG. 3, horizontal and upward vertical loads, and torques applied to the rigid element. Accordingly, number of ropes at each end of the rigid elements, its' cross sections, locations of the anchors relative to a rigid element, etc. should be designed. Due to perfect aerodynamic characteristics of the guy ropes the wind load on the supports 2 is greatly reduced in comparison with traditional towers.

A fixed position of the rigid elements prevents upward and transverse displacements of the cable in a plurality points where the rigid elements are placed. For further reduction of the transverse displacements of the cable 1, additional guy ropes (without rigid element) can be attached directly to the cable.

Figures 4, 5:
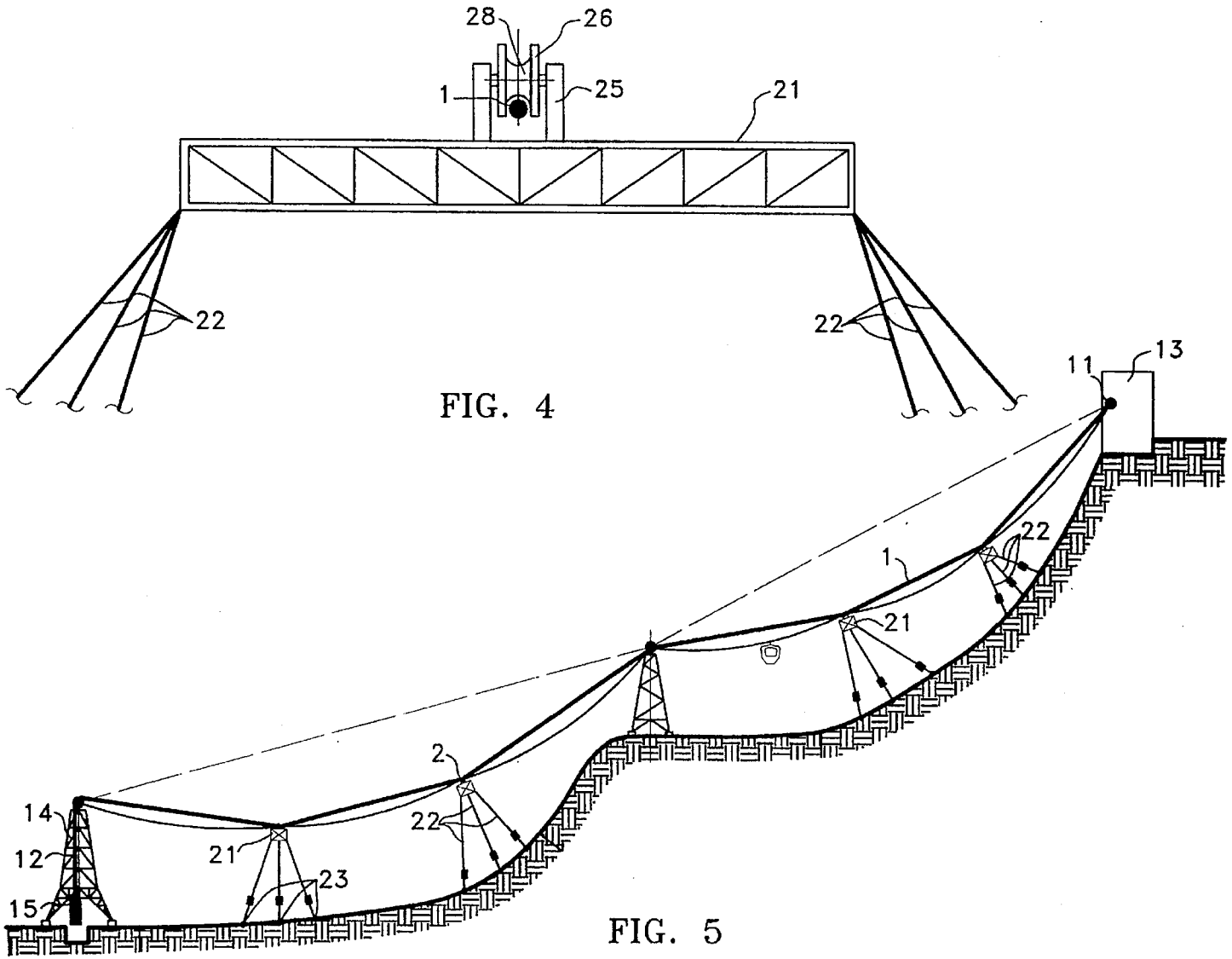
FIG. 4 is a fragment showing a contact between a saddle and a carrying cable.
FIG. 5 is a profile of a tramway with main components of the system for route with concave and convex portions.

For hanging the rigid element 21 from the carrying cable 1 a saddle 25 is used (FIG. 4). The saddle includes a track wheel 26 with a grooved rim 28 which provide a slipping contacts between the saddle and the cable. Thus, when the length of the cable 1 changes, for example, because of temperature elongation or in process of settling a profile of the cable, the cable slips by the saddle 25 and, accordingly, by a fixed rigid element 21.

In case of short span of the cable 1 the rigid element 21 can be attached directly to the cable (without the saddle 25) by any convenient way.

In some cases, profile of the ground along the route of the tramway may have a combination of concave and convex lines, as it is shown in FIG. 5. For such routes an additional tower(s) 3 for supporting the cable 1 should be installed at the concave portion. A sliding contact between the cable 1 and the tower 3 has to be provided. In other respects the invented system doesn't have essential changes.

The system can be used for whole route of aerial means or for its part, in combination with traditional towers.

An important advantage of the invented system in compare with traditional towers is that the system is much more reliable. Break of guy ropes or displacement of its' anchors because of storm, snow-slip, land slide, earthquake and other natural disasters doesn't destruct the system. Broken guy ropes can be easily replaced. The rigid elements which are actually, main supporting components of the aerial means are not subjected directly to additional loads in this case. The system isn't sensitive even to small displacements of the end supports of the cable 1.

Installation

Generally, a process of installation of the invented system consists of four main steps:

1. The carrying cable is stretched between its end supports. One end of the cable is anchored and the other is attached to a tensioning means. The tension load applied to the cable "at this step should not exceed the force necessary for ". stretching the unloaded cable between the supports.
2. Rigid elements with guy ropes and main supporting components of the aerial means, such as carrying ropes, hauling ropes, etc. are mounted on the carrying cable and hauled to its' working position. In the process of hauling lower ends of the guy ropes are raised above the ground.
3. The guy ropes are lowered on the ground just at the place they should be anchored. Then, the guy ropes are attached to previously installed anchoring means and pulled down until they reach projected lengths. By this way a projected profile of the carrying cable along a route of the aerial means is settled.
4. The tensioning of the cable is gradually increased to a design load. Accordingly, tension stress in the guy ropes is also increased. Lengths of the guy ropes are adjusted.

Figure 6:
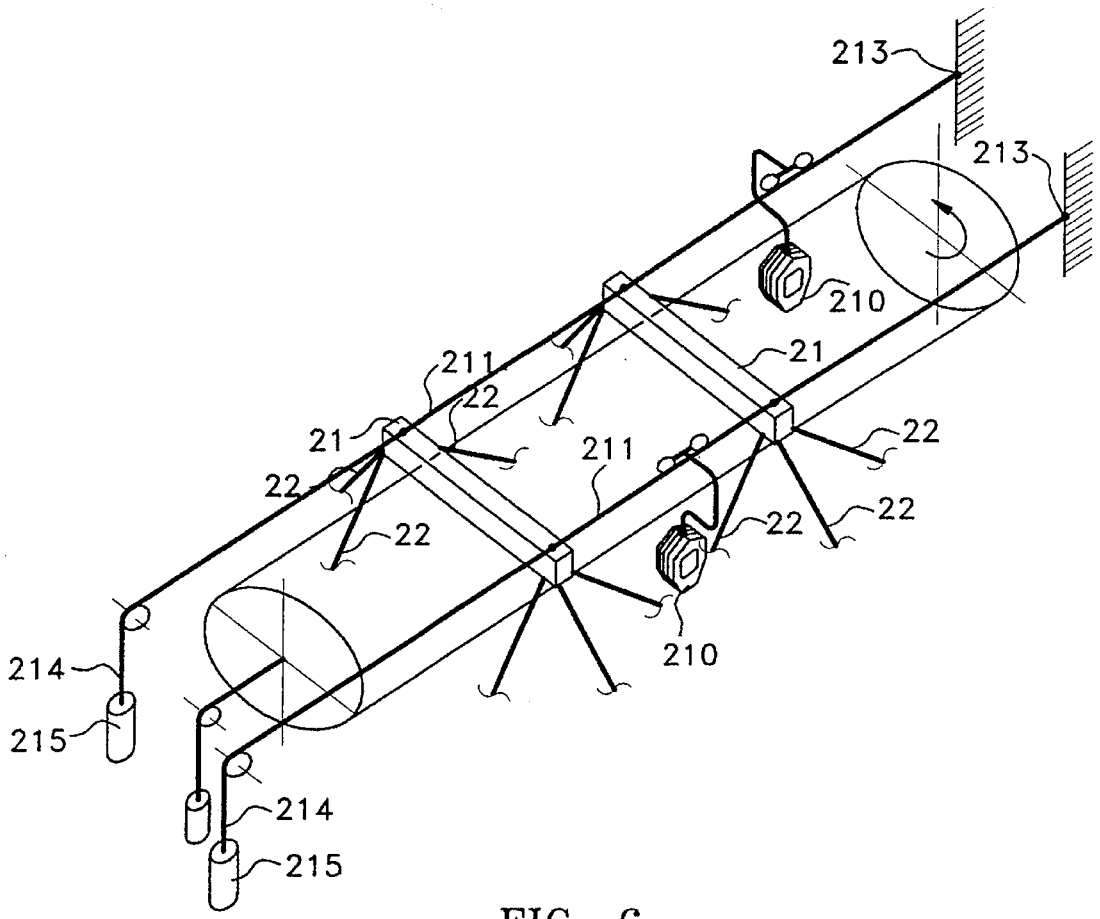
FIG. 6 is a scheme of a two-and-fro bicable ropeway with two cars.

Some types of aerial means include a carrying cable(s) used as a ropeway for a car. For example, to-and-fro bicable ropeway for two cars has two cables 211 supporting cars 210 moving along the cables (FIG. 6). One end 213 of each of these cables is anchored and the other 214 is attached to the tensioning means 215. The second version of the invention is based on using these carrying cables 211 as a main carrying element of the invented system of suspended supports instead of special cable described in the preferred embodiment. According to this version, a plurality of suspended supports hang from the carrying cables 211 of the aerial means (each rigid element is attached to both carrying cables 211). The saddles, in comparison with the preferred embodiment, includes also a bypass way over the track wheel of the saddle which is used for riding cars by the suspended supports. A smooth transition of the car's roller from the carrying cable to the bypass way and back to the carrying cable should be provided.

In some cases a mobile aerial means for elevating people or freight, for example in mountains, is required. The following is the the third version of the invented system possessing such features. This version, in compare with the preferred embodiment includes anchorage and tension stations made as a prefabricated blocks combining supporting structures and necessary equipment. The blocks are delivered at any chosen site and installed on a preliminary constructed foundations. The length and the carrying capacity of the cable should cover a variety of spans between the stations and aerial means of different destinations. The same requirement is related to the guy ropes. In other respects the system isn't subjected to essential changes in compare with preferrer embodiment.

This invention is not limited to the details shown since various modifications and structural changes are possible without departing in any way from the spirit of the present invention. What is desired to be protected is set forth in particular in the appended claims.

What is claimed is:

1. System of suspended supports for aerial transportation and transmission means comprising:

at least one carrying cable placed along a route of said aerial means, suspended above the ground at both of its ends, having one end anchored and the other attached to a means for tensioning the cable;

a plurality of spaced supports for said aerial means hung from said cable;

each of said supports comprising a rigid element suitable for attaching to said carrying cable located substantially perpendicular to an axis of said route;

said rigid element having a saddle for hanging the rigid element from said cable, which saddle is attached to the rigid element and slidably supported by the cable;

guy ropes having one end affixed to said rigid element and another end anchored, carrying horizontal and upward vertical loads, and torques applied to the rigid element, being stressed by said cable when the cable is tensioned;

each of said guy ropes having a length providing a designed level of the rigid element above the ground, and supplied with a device for adjusting its length.

2. A system of suspended supports according to claim 1, comprising a tower(s) for supporting the cable at a portion of the route of the aerial means where a profile of the cable is convex.

3. A system of suspended supports according to claim 1, wherein said means for tensioning the cable provides gradual increasing of the load applied to the cable, from a small load during a process of installation of the system to a designed load for a working regime of the system.

4. A system of suspended supports according to claim 1, wherein said saddle has at least one track wheel with a grooved rim setting on the cable, providing a sliding contact between the cable and said rigid element.

5. A system of suspended supports according to claim 1, wherein said at least one carrying cable is comprised of a plurality of carrying cables.

6. System of suspended supports for aerial transportation and transmission means comprising:

at least one carrying cable placed along a route of said aerial means, suspended above the ground by supporting means located at both ends of the cable, having one end anchored and the other attached to a means tensioning the cable;

a plurality of spaced supports for said aerial means hung from said cable;

each of said supports comprising a rigid element suitable for attaching to said carrying cable located substantially perpendicular to an axis of said route;

said rigid element affixed to said cable;

guy ropes having one end affixed to said rigid element and another end anchored in the ground or in a foundation placed on the ground, carrying horizontal and upward vertical loads, and torques applied to the rigid element, being stressed by said cable when the cable is tensioned;

each of said guy ropes having a length providing a designed level of the rigid element above the ground and means for adjusting the length of said guy ropes.

* * * * *